United States Patent [19]

Campo

[11] 4,095,754

[45] Jun. 20, 1978

[54] WINDING DEVICE AND CHUCK THEREFOR

[75] Inventor: Edgar Alfredo Campo, Columbus, Ohio

[73] Assignee: E. I. Du Pont de Nemours and Company, Wilmington, Del.

[21] Appl. No.: 780,909

[22] Filed: Mar. 24, 1977

[51] Int. Cl.[2] ..... B65H 17/08; B65H 35/02

[52] U.S. Cl. ..... 242/65; 242/56.2; 242/56.9

[58] Field of Search ..... 242/65, 56.2, 56.9, 242/68, 68.1, 68.2, 68.3, 67.1 R, 67.4, 67.2

[56] References Cited

U.S. PATENT DOCUMENTS

| | | | |
|---|---|---|---|
| 3,122,335 | 2/1964 | Dusenbery | 242/56.2 |
| 3,149,796 | 9/1964 | Godaf | 242/67.4 X |
| 3,188,016 | 6/1965 | Aaron | 242/56.9 X |
| 3,222,004 | 12/1965 | Crowe | 242/56.2 |

*Primary Examiner*—Edward J. McCarthy

[57] ABSTRACT

A slit web rewinding assembly is disclosed, including a winding device with a pivotal arm, a chuck, and a pressure-regulated fluid cylinder. The chuck includes at least one core retaining spring of special design and the fluid cylinder is universally connected to the arm by a ball and socket.

11 Claims, 7 Drawing Figures

WINDING DEVICE AND CHUCK THEREFOR

This invention relates to high-speed winding devices providing vibration-free operation at constant winding tension. The invention particularly pertains to slit web rewinding devices for winding ribbons cut from a web onto individual cores.

Several winding devices have been previously disclosed.

U.S. Pat. No. 3,122,335 discloses a motor-driven winding device having a pivotal arm with a core adapter chuck at one end and a fluid cylinder at the other end. The fluid cylinder is joined with the arm and with a base member by pin means which limit motion to one plane. The fluid cylinder, in operation, forces the arm against a winding drum with no counter force means.

U.S. Pat. No. 3,866,853 also discloses a winding device with an arm, a core carrier, and a fluid cylinder. The fluid cylinder is joined only to the arm and causes the arm to bear against a winding drum by means of a roller, mounted on the cylinder piston rod, acting against a base member camming plate. The fluid cylinder, in operation, forces the arm against the winding drum with no counter force means.

U.S. Pat. No. 2,460,694 discloses hydraulic web tension control in a slit web rewinding assembly wherein the tension of individual slit strips provides a continuous hydraulic signal for regulating the force of the arm against the winding drum. The fluid cylinder and the arm cooperate by means of a rack and pinion.

U.S. Pat. No. 2,872,126 discloses a winding device having a double acting fluid cylinder to control the force of the arm against the winding drum. The winding device is friction-driven. The fluid cylinder is joined with the arm and with base means by pins which limit motion to one plane.

U.S. Pat. Nos. 3,322,361 and 2,833,488 disclose friction-driven winding devices fitted with core adapter chucks. Each core is disclosed to be held vise-like at its edges by a pair of core adapter chucks or by an individual core adapter chuck. Each core adapter has a tubular garter spring resting on a resilient member at the bottom of a groove in the adapter. The garter spring is not radially deformed during use, but provides a high friction surface to prevent rotational slippage of cores due to radial forces exerted by the resilient member beneath the spring.

Winding devices of the prior art exhibit deficiencies in operation, especially when used at high wind-up speeds and when used to wind narrow ribbons of material. Problems caused by parts fitting together too loosely or too tightly, at assembly or after use, are accentuated at high wind-up speeds. Loose-fitting parts tend to vibrate, tighter fitting parts bind together, and neither permit wind-up at constant tension. Wound rolls made at high speed without adequate tension control tend to chatter and bounce on the winding drum resulting in flat spots and uneven edges.

According to the present invention, a winding device is provided having elements fitted and related together to provide continued, vibration-free, high speed operation with wind-up tension control, resulting in uniformly round rolls having even edges. The winding device of this invention comprises: an arm; a chuck rotatably mounted on one end of the arm; a socket fixedly mounted to the other end of the arm; a base pivotally joined to the arm between the ends of the arm; and a fluid cylinder comprising, a piston rod pivotally mounted on the base, a cylinder casing operatively engaging the piston rod, and a ball carried on the casing mated with the socket to universally connect the fluid cylinder to the arm. The chuck of this invention comprises: a mandrel; a housing rotatably mounted on the mandrel and having at least one groove with a floor cut around the periphery of the housing; and a spring in at least one groove wherein the spring comprises, a bottom contacting the floor of the groove, and a plurality of cantilevered fingers joined to one edge of the bottom and extending out of the groove.

Embodiments of the invention are illustrated in the following drawings wherein.

Figure 3:
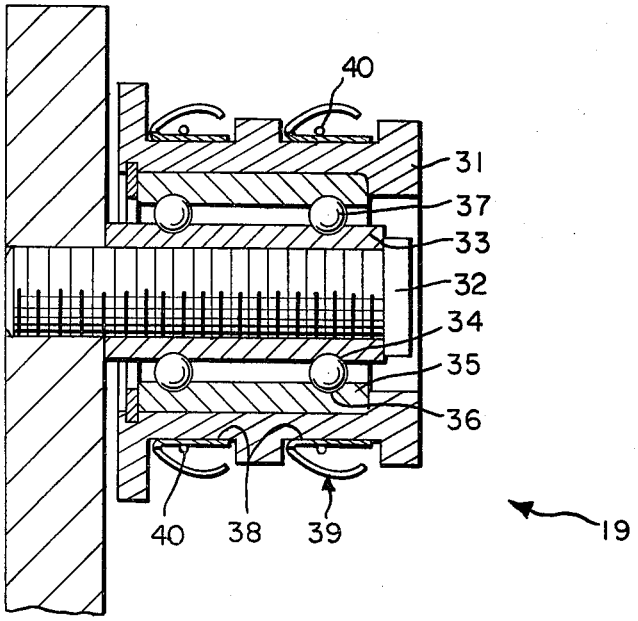
FIG. 3 is a cross-sectional representation of a chuck for the device of FIG. 2.
Figure 4A:
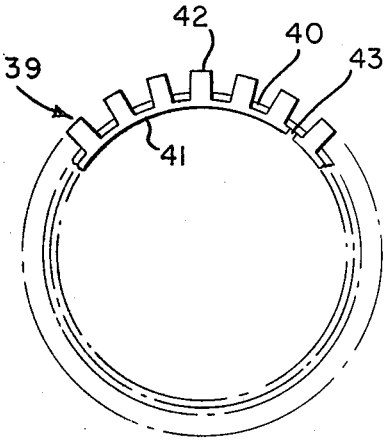
Figure 4B:
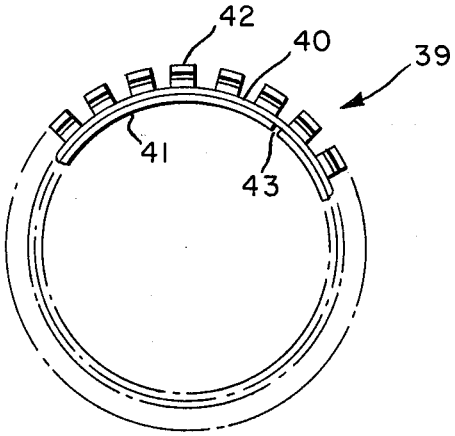

FIGS. 4*a* and 4*b* are opposite side views of a retaining spring used in the chuck of FIG. 3.

Figure 5A:
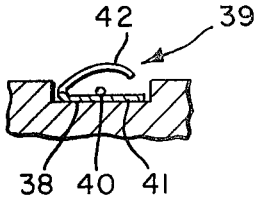
Figure 5B:
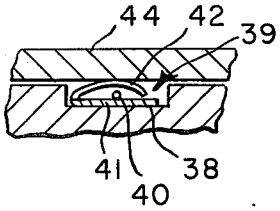

FIGS. 5*a* and 5*b* are cross-sectional representations of the retaining spring in place on the chuck. FIG. 5*a* represents the spring in unbiased condition. FIG. 5*b* represents the spring with a core on the chuck.

Figure 1:
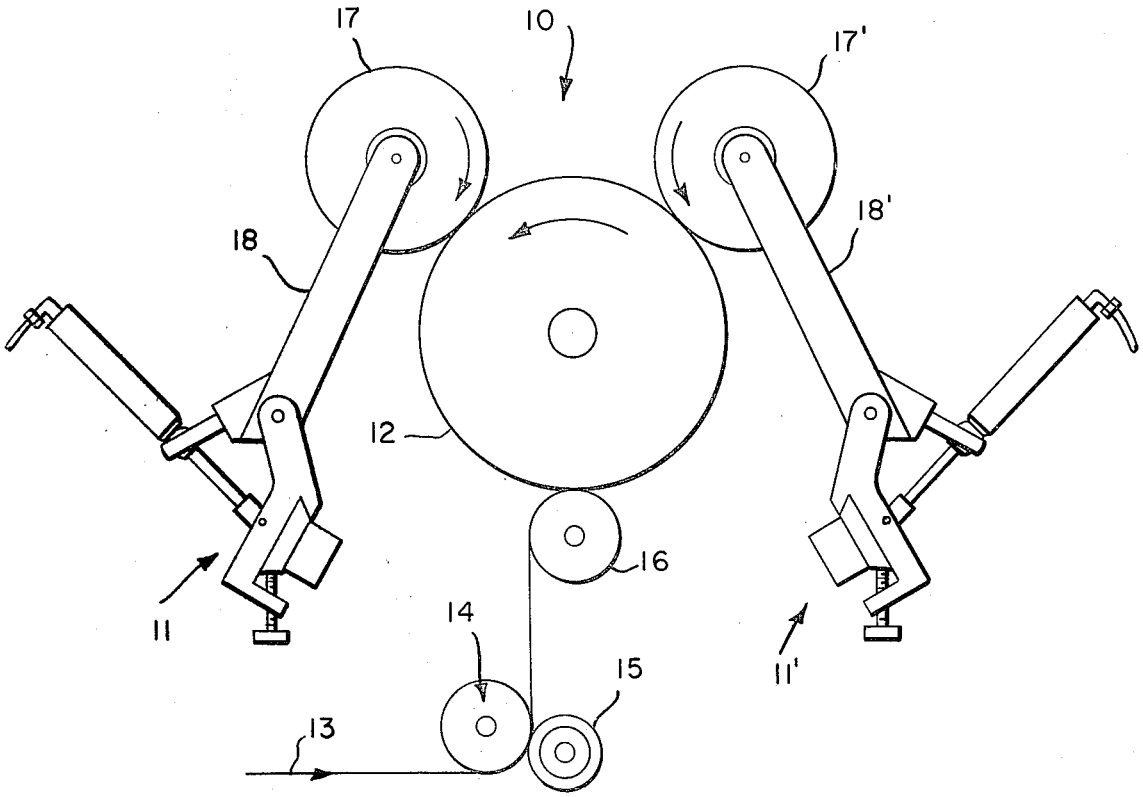
FIG. 1 is an end view representation of a slit web rewinding assembly including winding devices of this invention.

Referring to FIG. 1, the end view of a slit web rewinding assembly 10 is shown in detail adequate to illustrate the relation between winding devices 11 and 11' and winding drum 12. A web 13 passes over backing roll 14 where it is slit into ribbons by cutter 15. The web 13, now slit, passes nip roll 16 and around winding drum 12 until individual ribbons encounter and are taken up on rolls 17 and 17' of the individual ribbons. The rolls 17 and 17' are wound on cores carried by chucks on arms 18, 18' of slit web winding devices 11, 11'. One or a plurality of winding devices 11, 11' can be used as illustrated mounted side-by-side along the length of a winding drum 12 and mounted at two or more locations around the periphery of a winding drum 12. Winding drum 12 is driven and is contacted by rolls 17 and 17' as they are wound. As will be explained, the force of that contact is adjusted to be constant over the course of each winding operation and is herein referred to as winding tension. Each winding device operates independent of the others and winding tension for each device is individually adjustable. Rolls 17 and 17' are preferably driven only by contact with winding drum 12 and receive no other driving forces. However, when the additional weight of a motor drive would not be detrimental to high speed operation or when especially thick film is to be slit and wound, the chucks which carry the cores and rolls can be motor driven.

Figure 2:
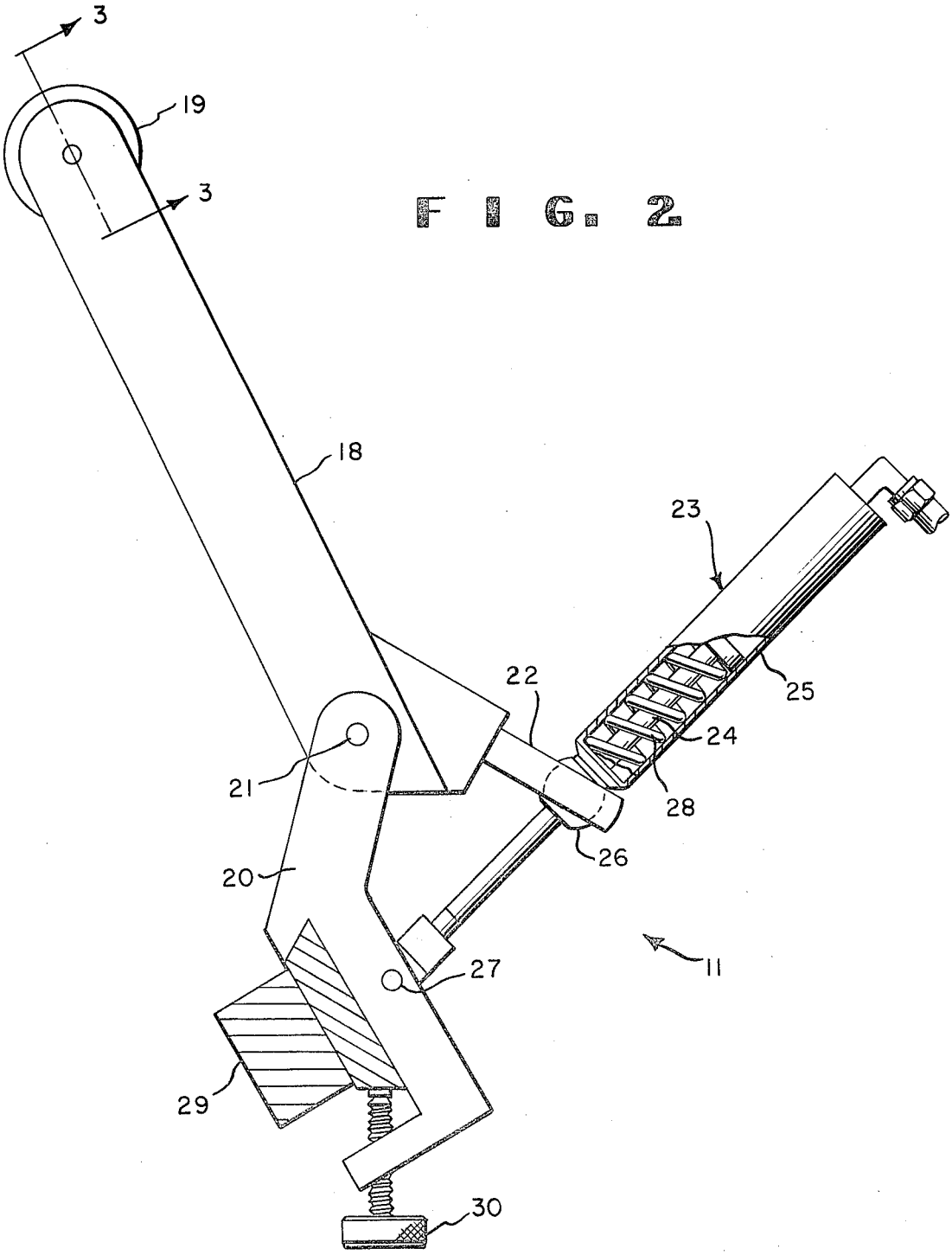
FIG. 2 is a side view representation of a winding device from the assembly of FIG. 1.

FIG. 2 represents an enlarged side view, in partial cutaway, of a winding device 11. Arm 18 carries chuck 19 on which is mounted a core for winding ribbons of slit web. The arm 18 is pivotally joined with base 20 by means of shaft 21 and a bearing surface in arm 18 to permit no significant lateral movement. Socket 22 is fixedly mounted to arm 18 at the end opposite chuck 19. Fluid cylinder 23 comprising piston rod 24 operatively engaged in cylinder casing 25 carrying ball 26 is universally connected to arm 18 by means of ball 26 and socket 22; and piston rod 24 is loosely pivotally mounted to base 20 by pin 27. Cylinder spring 28 (shown by partial cutaway of cylinder casing 25) exerts a force to pull arm 18 away from the winding drum. Base 20 is adjustably fixed to frame member 29 by hold down bolt 30. Fluid is introduced into fluid cylinder 23 under constant pressure, adjustably controlled, for example, by a regulator (not shown). The fluid pressure is adjusted to counteract the force from cylinder spring 28 and permit the desired degree of contact between core and winding and the winding drum.

FIG. 3 is a cross-sectional view, along site lines indicated in FIG. 2, of chuck 19 rotatably mounted to the end of arm 18. Bolt 32 securely fixes mandrel 33 having inner races 34 to arm 18. Chuck housing 31 is fixed to cylinder 35 having outer races 36 and is rotatably mounted on arm 18 by means of bearings 37 riding in inner races 34 and outer races 36. The rotatable mounting of chuck housing 31 is constructed to eliminate lateral movement and wobble. In the case of ball bearings, wobble is decreased by utilizing more than one set of balls and races. At least one floored groove 38 is cut around the periphery of chuck housing 31 and circular core adapter springs 39 are fitted therein. The springs 39 are secured against the floor of the grooves 38 by means of stretchable retaining rings 40. Wobble between springs 39 and any core mounted thereon is minimized by use of more than one spring 39. More than one spring 39 can be used in one groove 38.

As can be seen from FIG. 3, core adapter spring 39 has a bottom portion which rests in contact with the floor of grooves 38 and a peaked, cantilever, top portion which extends, in unbiased condition, beyond the upper limit of groove 38. FIGS. 4*a* and 4*b* represent opposite views of core adapter spring 39. FIG. 4*a* is an edge view from the cantilever side. FIG. 4*b* is an edge view from the open side. The bottom portion 41 forms a circular base for spring 39 and from one edge of the base extend a plurality of peaked cantilever fingers 42. The spring 39 is a split ring, as is evidenced by space 43, and is held in shape by retaining ring 40.

FIGS. 5*a* and 5*b* are cross-sectional representations of core adapter spring 39 as it rests in groove 38 unbiased (FIG. 5*a*) and as it rests in groove 38 in use to retain a core 44 (FIG. 5*b*). Bottom portion 41 is secured in place by retaining ring 40. In FIG. 5*a*, peaked, cantilever fingers 42 are shown in the unbiased position extending out, beyond the upper limit, of groove 38, peaked, and pointing back toward bottom 41. In FIG. 5*b*, fingers 42 are shown in biased position wherein core 44 forces the top of fingers 42 into groove 38. The ends of fingers 42 do not contact either the bottom portion 41 of spring 39 or the side or floor of groove 38.

Elements of the winding device of this invention are joined together in a way to minimize vibration and yet insure smooth operation without danger of the elements binding together. The ball and socket joint between the fluid cylinder and the arm permits close-fitting and smooth operation even when the arm and piston rod might be mounted to the base out of alignment or when they may have been bent or worn out of alignment by use of handling.

The ball and socket of this device permits stable, vibration-free operation in a very narrow structure. Use of the ball and socket precludes necessity for pins, bearings, shoulders and the like in the jointure between the arm and the fluid cylinder. The narrow structure is important to permit assembly of a multitude of the winding devices in side-by-side operation to wind very narrow ribbons. The sturdy, universal, construction provided by a ball and socket jointure is especially important for narrow devices because, the narrow devices are more likely to be bent out of alignment in the normal course of operation.

To increase stability of high speed operation by reducing chatter and bounce of wound rolls against the windup roll, the fluid cylinder can be of the double acting variety, with counter forces to positively position the piston rod. The counter forces are preferably provided by means of a spring bias producing light force on the core and the arm away from the winding drum and a pressure-regulated fluid base producing the counter force against the winding drum. In such a preferred arrangement, the spring bias pulls the piston rod into the cylinder casing and the fluid bias pushes the piston rod out of the cylinder casing. In operation, the fluid bias is controlled to be only slightly greater than the spring bias and the fluid bias serves as a vibration damper to absorb bounce and chatter movements of the arm away from the winding drum.

The chuck, with one or more core adapter springs, combines a minimum of vibration and wobble in winding operations with ease of mounting cores and removing wound rolls of film. The chuck is fitted with one or more springs to provide a level foundation for cores. The springs each have a plurality of fingers which fingers are individually, easily, deformed. The fingers, being spaced around the chuck periphery, exert a plurality of small, equal, outward forces which are easily overcome to mount a core or remove a completed roll. Those small forces, however, hold a core completely free from wobble in the plane of winding.

The combination of universal ball and socket mounting of the fluid cylinder to the arm and use of chuck with the core adapter springs having cantilevered fingers for each core to be wound, result in vibration-free high speed operation. Wound rolls of material are circular, have straight edges, and a uniform ribbon tension.

The winding device of this invention can be used to wind ribbons of any flexible slit web material. Slit films, foils and webs of paper, metal, synthetic or treated polymeric material, combinations or laminates of such materials, and the like, can be wound using the device of this invention. While films as thick as 350.0 microns or more can be wound using the device of this invention, this device is particularly suited for winding slit webs of thin gauge polymeric film such as polyester film from about 1.0 to about 100.0 microns in thickness.

The winding device can be used to advantage at any winding speed but provides special advantage at winding speeds of greater than about 60 meters per minute (200 feet per minute) for films more than about 50.0 microns thick and greater than about 150 meters per minute (500 feet per minute) for films less than about 50.0 microns thick. Winding speeds of at least as high as 450 meters per minute (1500 feet per minute) can be attained using this winding device, to produce wound rolls of high quality.

Ribbons of material of any width can be wound. For wide ribbons, additional core adapter springs are recommended. For wide ribbons of heavy material, two arms can be used. When two arms are used, the chucks can be adjusted to face each other and each chuck can be used to support one end of a core. Due to the stability of cores on the chucks of this invention, more than one narrow ribbon can be wound on a single core.

What is claimed is:

1. A winding device comprising an arm a chuck comprising
a mandrel fixed on one end of the arm
a housing rotatably mounted on the mandrel and having at least one groove with a floor cut around the periphery of the housing
a spring in at least one of the grooves wherein the spring comprises
a bottom contacting the floor of the groove
a plurality of cantilevered fingers joined to one edge of the bottom and extending out of the groove
a socket fixedly mounted to the other end of the arm
a base pivotally joined to the arm between the ends of the arm
a fluid cylinder comprising
a piston rod pivotally mounted on the base
a cylinder casing operatively engaging the piston rod
a ball carried on the casing mated with the socket to universally connect the fluid cylinder to the arm.

2. The winding device of claim 1 wherein the cantilevered fingers are peaked and point back toward the other edge of the bottom.

3. The winding device of claim 1 wherein the housing has two grooves cut around the periphery and wherein a spring is in each of the grooves.

4. The winding device of claim 1 wherein the fluid cylinder is double-acting with counter forces to positively position the piston rod.

5. The winding device of claim 4 wherein the counter forces are a spring means to pull the piston rod into the cylinder casing and a fluid means to push the piston rod out of the cylinder casing.

6. A winding device comprising
an arm
a chuck rotatably mounted on one end of the arm
a socket fixedly mounted to the other end of the arm
a base pivotally joined to the arm between the ends of the arm
a fluid cylinder comprising
a piston rod pivotally mounted on the base
a cylinder casing operatively engaging the piston rod
a ball carried on the casing mated with the socket to universally connect the fluid cylinder to the arm.

7. The winding device of claim 6 wherein the fluid cylinder is double-acting with counter forces to positively position the piston rod.

8. The winding device of claim 7 wherein the counter forces are a spring means to pull the piston rod into the cylinder casing and a fluid means to push the piston rod out of the cylinder casing.

9. A chuck for holding cores without wobble comprising
a mandrel
a housing rotatably mounted on the mandrel and having at least one groove with a floor cut around the periphery of the housing
a spring in at least one of the grooves wherein the spring comprises
a bottom contacting the floor of the groove
a plurality of cantilevered fingers joined to one edge of the bottom and extending out of the groove.

10. The chuck of claim 9 wherein the cantilevered fingers are peaked and point back toward the other edge of the bottom.

11. The chuck of claim 9 wherein the housing has two grooves cut around the periphery and wherein a spring is in each of the grooves.

* * * * *